United States Patent [19]

Peroni

[11] Patent Number: 5,063,923

[45] Date of Patent: Nov. 12, 1991

[54] COLD WEATHER GARMENT WITH RESPIRATION MEANS

[76] Inventor: Robert Peroni, Viale Stazione 3, I-39100 Bolzono, Italy

[21] Appl. No.: 568,789

[22] Filed: Aug. 17, 1990

[51] Int. Cl.[5] ..... A62B 18/08

[52] U.S. Cl. ..... 128/201.13; 128/200.24; 128/202.19; 128/204.17; 2/DIG. 1; 2/79

[58] Field of Search ..... 128/200.29, 201.13, 128/202.19, 201.26, 201.29, 204.17, 204.15; 2/DIG. 1, 79

[56] References Cited

U.S. PATENT DOCUMENTS

| | | | |
|---|---|---|---|
| 334,360 | 1/1886 | Elliot | 128/202.29 X |
| 771,801 | 10/1904 | Andrew | 128/202.19 X |
| 807,610 | 12/1905 | Ellis | 128/202.19 X |
| 1,009,083 | 11/1911 | McNamee | 128/202.19 X |
| 3,525,334 | 8/1970 | Braman et al. | 128/201.29 X |
| 3,529,595 | 9/1970 | Weeden | 128/202.19 |
| 4,185,327 | 1/1980 | Markve | 2/2 |
| 4,294,242 | 10/1981 | Cowans | 128/201.13 |
| 4,441,494 | 4/1984 | Montacbano | 128/204.17 |
| 4,461,292 | 7/1984 | Montacbano | 128/204.17 |
| 4,492,228 | 1/1985 | Makovic | 128/204.17 |
| 4,683,869 | 8/1987 | Wilcox | 128/201.13 X |
| 4,768,235 | 9/1988 | Webster | 128/201.26 X |
| 4,787,105 | 11/1988 | Phillips et al. | 128/201.13 X |
| 5,014,355 | 5/1991 | Vollenweider, II | 2/79 |

FOREIGN PATENT DOCUMENTS

| | | | |
|---|---|---|---|
| 1001897 | 1/1957 | Fed. Rep. of Germany | 128/202.19 |
| 1259207 | 1/1968 | Fed. Rep. of Germany | 128/201.13 |
| 1364599 | 2/1963 | France | 128/201.13 |
| 590065 | 2/1977 | Switzerland | 128/201.13 |
| 984481 | 1/1983 | U.S.S.R. | 128/204.17 |
| 1109174 | 8/1984 | U.S.S.R. | 128/204.17 |
| 1111765 | 9/1984 | U.S.S.R. | 128/204.17 |
| 929897 | 6/1963 | United Kingdom | 128/201.29 |
| 1115349 | 5/1968 | United Kingdom | 128/201.13 |

*Primary Examiner*—Edgar S. Burr
*Assistant Examiner*—Eric P. Raciti
*Attorney, Agent, or Firm*—Shlesinger Fitzsimmons Shlesinger

[57] ABSTRACT

A process is proposed for heat recovery with possible recovery and use of humidity yielded directly or indirectly by the human body and in particular to heat air to be breathed in the first case or to heat the body with exhaled hot air. In accordance with the invention the process includes a garment, a mouthpiece designed to be placed in the mouth for breathing by the user, said mouthpiece being connected through a flexible collecting tube with a collecting vessel arranged in the garment at the height of the user's chest, a discharge tube, for draining condensate from the vessel, and a further plurality of tubes connected at one end to the vessel, and at their opposite ends with at least one mixer chamber formed in the garment to receive heated air from the human body and fresh air from the outside, the heated air being taken from the proximity of the human body through an air permeable inner layer of the garment for communication with interstices of a filling material interposed between the inner permeable layer and an outer air-tight thermally impermeable layer of the garment.

4 Claims, 2 Drawing Sheets

COLD WEATHER GARMENT WITH RESPIRATION MEANS

DESCRIPTION

The present invention relates to a process for recovery of heat yielded directly or indirectly by the human body, and to a device for effecting such recovery.

The problem presenting itself to humas exposed to cold weather when in addition to having is that while they must thermally protect their body at low external temperatures, they are also forced to breathe correspondingly cold outside air. Heretofore the problem of breathing such cold air has not been solved without appropriate addition of auxiliary heat. The object of the present invention is to provide a simple and economical process to permit a user of a thermally protective garment to breathe at least partially warmed air so as to save himself or herself from possible damage to his or her health.

Another object of the present invention consists of the proposal of a device for effect the process described, and in such a manner as to be able to apply the process to already existing garments or even sleeping bags.

These and other objects are met in accordance with the invention by means of a process for recovery of heat yielded directly or indirectly by the human body with possible recovery or use of humid air characterized in one embodiment by filtering the heated air directly from the human body, conveying the filtered air and mixing it with fresh air by means of a pumping action and/or by depression, and conveying the air thus integrated to be breathed by the user.

This and other objects are also met by a device comprising a mouthpiece designed to be placed in the mouth of the user for breathing air, a flexible collecting tube connecting the mouthpiece with a collecting vessel on the inside of a garment for example at the height of the user's chest from the side opposite the entrance of the collecting tube with the collecting vessel there being connected an exhaust tube for exhausting condensation from the vessel, and a further plurality of tubes each connected at one end with the vessel near the collecting tube and being connected each at its opposite end with a mixer designed to receive heated air from the human body, each mixer being arranged in the garment near the different parts of the human body in an inner layer permeable to air and humidity of the garment and communicating with interstices of a filling material between said inner permeable layer and a thermally impermeable air-tight outer layer.

In a preferred form of embodiment each mixer is formed of a pierced sheet sewn in an opening of the garment's inner layer and communicating with the outer air through a one-way butterfly valve to the inside of the garment.

Further characteristics and advantages of the device made in accordance with the invention will be made clear by the following description of a preferred form of embodiment thereof shown in the figures of the annexed drawings wherein.

Figure 1:
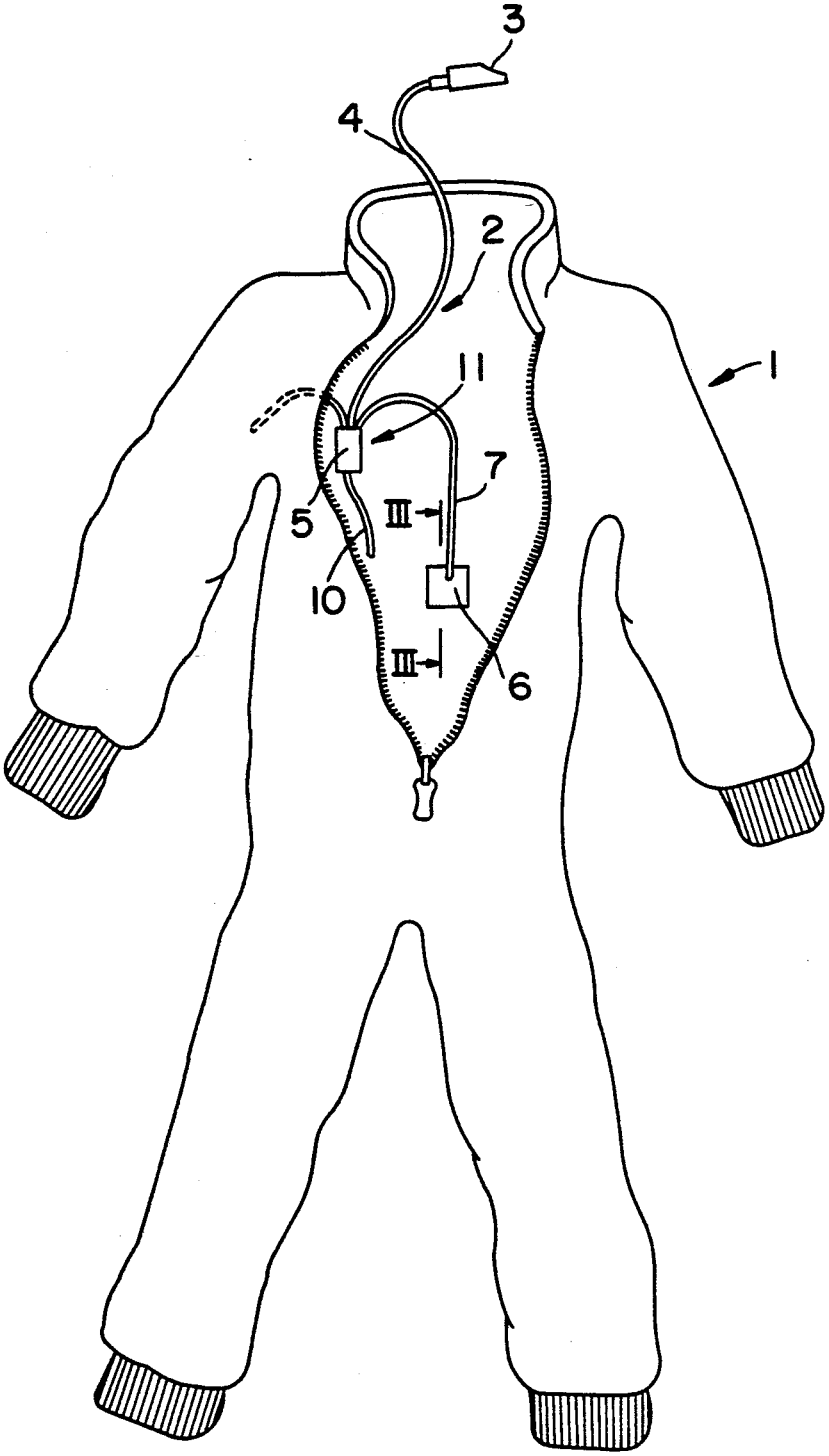
FIG. 1 shows schematically a perspective view of a garment.

As shown in FIG. 1 a protective coverall generally indicated by reference number 1 is provided with a device for recovering body heat possible use of humidity in accordance with the invention generally indicated by reference number 2.

As shown in FIG. 1 the device 2 includes a mouthpiece 3 designed to be placed in the mouth of a of the person wearing coverall 1, a collecting tube 4 connecting the mouthpiece 3 with a collecting vessel 5, at least one static mixer 6 in the coverall 1 communicating with the collecting vessel 5 through a tube 7. The collecting vessel 5 is preferably arranged at the height of the user's chest.

Figure 2:
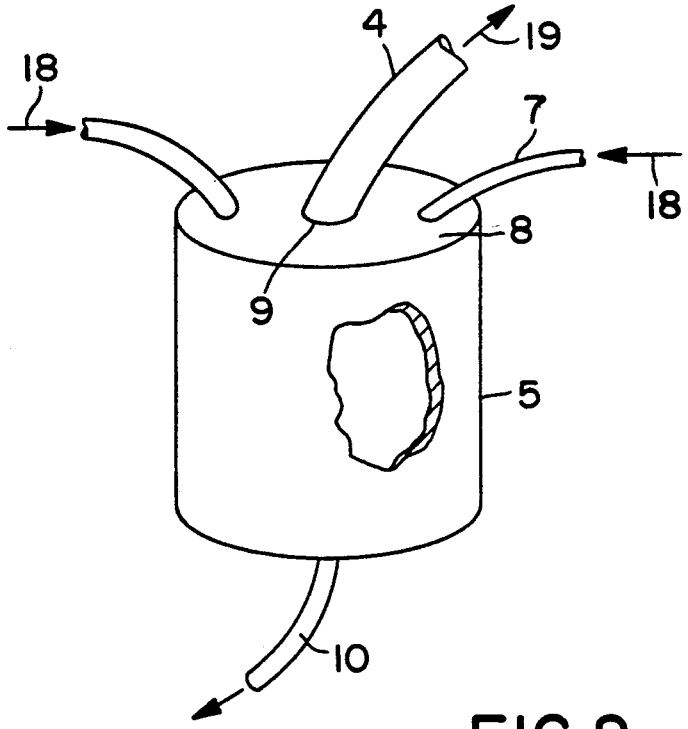
FIG. 2 shows schematically an enlarged perspective view of the detail II of FIG. 1.

As shown in FIG. 2 the collecting vessel 5 is a hollow cylindrical body closed at the top by a cover 8 into the centre 9 of which leads the collecting tube 4. Tube 7 communicates with vessel 5 through an opening offset from the centre 9 of the cover 8. From the bottom of the collecting vessel project a 10 which is designed to discharge the condensed water formed inside the collecting vessel 5.

Figure 3:
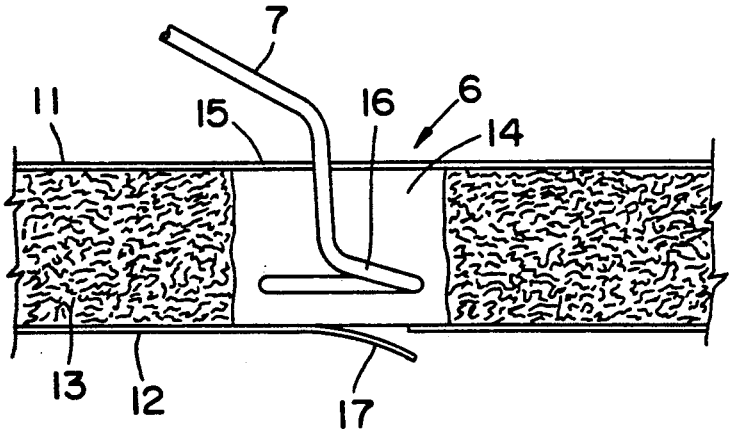
FIG. 3 shows an enlarged schematic cross section view of the garment taken along line III—III of FIG. 1 looking in the direction of the arrows.

In FIG. 3 it can be seen that the coverall 1 consists in a known manner of an inner layer 11 which is permeable to the air and humidity, an outer, insulating layer 12; and of filling material placed between the layer 11 and a layer 13 of the layer 12.

The inner layer 11 is preferably formed of a material with microcapillary effect which allows one-way passage of air and moisture to the filling material 13. The latter has a constitution such that it can retain in its interstices the moisture while allowing air to pass to a chamber 14 made in the filling material and making up part of the mixer 6. The chamber 14 of the mixer 6 is closed on the side of the inner layer 11 by a sheet 15 preferably pierced and sewn to the latter. The sheet 15 is traversed by the tube 7 one end of which has its terminal portion 16 preferably coiled in the chamber 14. The terminal portion 16 has preferably a wall provided with perforations (not shown) so as to facilitate flowing of air in the tube 7.

On the side of the outer layer 12 the chamber 14 is closed by a valve shown schematically as a butterfly valve 17.

Application and operation of the device in accordance with the invention are as follows.

Inserted in a garment for example coverall 1, is a plurality of mixers 6 each near the zone of the human body whose yielded heat can be better accumulated. By means of breathing through the mouthpiece 3, optionally assisted by a pumping action, effected, for example, by movement of the limbs of the wearer acting on the cushion of filling material 13, the air heated by the human body is made to flow through the inner layer 11 with moisture retained in the filling material 13, and to be mixed with fresh air entering through the valve 17. Then the air thus mixed with optional addition of air entering through the sheet 15, passes through the terminal aperture and the holes of the terminal portion 16 of the tube 7 to be conveyed in the direction indicated by the arrow 18 into the collecting vessel 5. Moisture still present in excess can be collected in the collecting vessel 5 to be discharged in the form of condensate through the tube portion 10. The heated air thus mixed with fresh air is then breathed in the direction of the arrow 19 through the collecting tube 4. Naturally the principle of recovering heat yielded by the human body can also be employed in sleeping bags or any other protective covering.

Contrariwise exhaled air could be utilized to recover the heat to heat the human body.

I claim:

1. A process for recovering body heat yielded directly or indirectly by a human body enclosed within a garment and utilizing the recovered heat for heating air which is to be breathed by the person wearing the garment, and characterized by the steps of providing a garment having an inner, air permeable layer, and outer air-tight thermally impermeable layer with a layer of moisture absorbent filling material interposed between said inner and outer layers, forming a chamber in an opening in said layer of filling material, said chamber being bound at one side by said inner layer, and at its opposite side by said outer layer having therein a one-way valve for admitting fresh air to said chamber from the exterior of said garment, providing in said garment a collecting vessel which communicates through a flexible tube with the mouth of the person wearing the garment, and connecting the interior of said vessel with said chamber through at least one other tube, whereby the body heat generated in said chamber warms the fresh air entering said chamber prior to conveyance thereof through said vessel to the mouth of the person wearing the garment.

2. The process as defined in claim 1 characterized in that the body movements of the person wearing said garment affect a pumping action which assists in the transfer of heated air from said chamber to the mouth of the person wearing the garment.

3. Apparatus for utilizing the body heat of a person for warming air which is to be breathed by the person, comprising a garment adapted to be worn by a person, and having a layer of filling material interposed between an inner and an outer layer of said garment, a chamber formed in said layer of filling material in said garment to communicate at the exterior of said garment with fresh air, and at the interior of said garment with the heat generated by the body of the person wearing the garment, a collecting vessel mounted on said garment, and having one of more flexible tubes connecting the interior of said vessel with the interior of said chamber in said garment, and a mouthpiece connected at one end by a tube to the interior of said vessel, and disposed to be retained at its opposite end in the mouth of the person wearing the garment in order to permit the person to breathe in air from said vessel, and to exhaust air into said vessel, and an exhaust tube connecting said vessel to the exterior of said garment for discharging from said vessel any condensate produced therein.

4. Apparatus as defined in claim 3, wherein said layer of filling material interposed between the inner and outer layers of said garment comprises a material permeable to air and humidity, and disposed to have therein interstices for retaining moisture while allowing air to pass therethrough to said chamber.

* * * * *